US008957331B2

(12) United States Patent
Matsumoto

(10) Patent No.: US 8,957,331 B2
(45) Date of Patent: Feb. 17, 2015

(54) OPERATION UNIT AND ELECTRONIC APPARATUS

(75) Inventor: Kenji Matsumoto, Kanagawa (JP)

(73) Assignee: Sony Corporation (JP)

( * ) Notice: Subject to any disclaimer, the term of this patent is extended or adjusted under 35 U.S.C. 154(b) by 237 days.

(21) Appl. No.: 13/459,918

(22) Filed: Apr. 30, 2012

(65) Prior Publication Data

US 2012/0292161 A1 Nov. 22, 2012

(30) Foreign Application Priority Data

May 20, 2011 (JP) ..... 2011-114202

(51) Int. Cl.
*H01H 9/00* (2006.01)
*H01H 25/06* (2006.01)
*H01H 25/04* (2006.01)

(52) U.S. Cl.
CPC ..... *H01H 25/041* (2013.01); *H01H 25/065* (2013.01); *H01H 2025/045* (2013.01); *H01H 2025/048* (2013.01)
USPC ..... 200/4

(58) Field of Classification Search
CPC ..... H01H 25/041; H01H 25/065; H01H 2025/045; H01H 2025/048; H01H 25/06; H01H 25/008
USPC ..... 200/4, 5 A, 6 A, 14, 5 R
See application file for complete search history.

(56) References Cited

U.S. PATENT DOCUMENTS

| | | | | |
|---|---|---|---|---|
| 7,119,290 | B2 * | 10/2006 | Kim | 200/5 R |
| 7,310,084 | B2 | 12/2007 | Shitanaka et al. | |
| 7,342,187 | B2 * | 3/2008 | Yamaguchi | 200/14 |
| 7,405,728 | B2 * | 7/2008 | Arakawa et al. | 345/184 |
| 8,502,093 | B2 * | 8/2013 | Kishimoto et al. | 200/5 A |
| 2002/0144882 | A1 * | 10/2002 | Yamaguchi | 200/4 |
| 2008/0011590 | A1 | 1/2008 | Montalvo et al. | |
| 2012/0055763 | A1 * | 3/2012 | Chou | 200/4 |

FOREIGN PATENT DOCUMENTS

| | | |
|---|---|---|
| JP | 06-178371 | 6/1994 |
| JP | 08-077694 | 3/1996 |
| JP | 2005-317337 | 11/2005 |
| JP | 2005-317376 | 11/2005 |
| JP | 2006-012695 A | 1/2006 |

(Continued)

OTHER PUBLICATIONS

Office Action from Japanese Application No. 2011-114202 dated Nov. 18, 2014.

*Primary Examiner* — Edwin A. Leon
(74) *Attorney, Agent, or Firm* — Lerner, David, Littenberg, Krumholz & Mentlik, LLP

(57) ABSTRACT

An operation unit which may include a rotating dial operated by being rotated about a predetermined reference axis; a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated. The rocking key is inclined when the to-be-pressed part is operated by being pressed, in such a manner that a position on a roughly 180° opposite side of the reference axis from the to-be-pressed part serves as a fulcrum.

10 Claims, 12 Drawing Sheets

(56) References Cited

FOREIGN PATENT DOCUMENTS

| | | |
|---|---|---|
| JP | 2009-117209 A | 5/2009 |
| JP | 2009-170196 A | 7/2009 |
| JP | 4461337 | 2/2010 |
| JP | 4468431 | 3/2010 |

* cited by examiner

OPERATION UNIT AND ELECTRONIC APPARATUS

CROSS-REFERENCE TO RELATED APPLICATION

The present application claims priority from Japanese Patent Application No. JP 2011-114202 filed in the Japanese Patent Office on May 20, 2011, the entire content of which is incorporated herein by reference.

BACKGROUND

The present technology relates to an operation unit and an electronic apparatus. More specifically, the present technology relates to a technical field in which a rocking key is inclined when a to-be-pressed part is operated by being pressed, in such a manner that a position on a roughly 180° opposite side of a reference axis from the to-be-pressed part serves as a fulcrum, whereby enhanced operability and enhanced reliability of operation can be promised through enlargement of the operation unit.

Various electronic apparatuses, for example, recording/reproduction devices, sound recording/playback devices, acoustic devices, imaging devices, network communication devices, or information processing devices such as personal computers and PDAs (Personal Digital Assistants) are each provided with an operation unit (or console unit) for performing predetermined operations.

As an operation unit, for example, there has been one having a configuration in which a to-be-operated part formed in a circular disk-like shape and a shaft part projected from a central portion of the to-be-operated part and which is rocked by being inclined with the tip of the shaft part as a fulcrum when an outer circumferential portion of the to-be-operated part is pressed (see, for example, Japanese Patent No. 4046107).

In the operation unit described in Japanese Patent No. 4046107, a turning body provided as the to-be-operated part and an operation body provided as the shaft part are provided, and the operation body is provided with a plurality of arm parts projected outward. When the outer circumferential portion of the to-be-operated part is operated by being pressed, the whole part is inclined (rocked) with the tip of the shaft part as a fulcrum, and a push switch is pushed by a tip portion of the arm part, whereby a predetermined function is carried out.

SUMMARY

Meanwhile, in the operation unit having a rocking key as above-mentioned, an inclination angle necessary in the operation unit is determined according to the distance from the fulcrum of oscillation to the tip portion of the arm part (see FIG. 12).

Specifically, in a configuration in which a to-be-operated part a and a shaft part b are provided and push switches e, e, . . . are pushed respectively by tip portions d, d, . . . of arm parts c, c, . . . , an inclination angle θ is determined based on the moving distance D necessary for the tip portion d of the arm part c to push the push switch e when a rocking operation is performed.

The inclination angle θ increases with the moving distance D. When the inclination angle θ is enlarged, the displacement H in the direction orthogonal to the moving distance D is enlarged. When the to-be-operated part a is operated by being pressed, therefore, an outer circumferential portion f of the to-be-operated part a is liable to make contact with other part g of the operation unit, whereby operability may be lowered.

On the other hand, in order to attain enhanced operability, it is preferable for the to-be-operated part a to be enlarged in the direction orthogonal to the shaft part b (in the direction orthogonal to the moving direction D). When the to-be-operated part a is enlarged, however, the outer circumferential portion f of the to-be-operated part a becomes more liable to make contact with other part h when the oscillating operation is performed. For preventing the outer circumferential portion f of the to-be-operated part a from making contact with the other part h, therefore, it is desirable to reduce the inclination angle θ. When the inclination angle θ is reduced, however, it may become very difficult to secure the moving distance D necessary for pushing the push switch e, thereby lowering the reliability of operation.

Thus, there is a need for an operation unit and an electronic apparatus by which the above-mentioned problems can be solved and by which enhanced operability and enhanced reliability of operation can be promised through enlargement of the operation unit.

In order to solve the above-mentioned problems, according to an embodiment of the present technology, there is provided an operation unit including: a rotating dial operated by being rotated about a predetermined reference axis; a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated; wherein the rocking key is inclined when the to-be-pressed part is operated by being pressed, in such a manner that a position on a roughly 180° opposite side of the reference axis from the to-be-pressed part serves as a fulcrum.

In the operation unit, therefore, the rocking key is inclined in such a manner that the position on the roughly 180° opposite side of the reference axis from the to-be-pressed part serves as a fulcrum, whereby the push switch is pushed.

Accordingly, even where the operation unit is enlarged, the to-be-operated part is less liable to make contact with other part of the operation unit when the rocking key is rocked. Therefore, enhanced operability and enhanced reliability of operation can be promised through enlargement of the operation unit.

Secondly, in the above-mentioned operation unit, desirably, the rocking key is provided with a plurality of the to-be-pressed parts, and the plurality of to-be-pressed parts are located at intervals along a circumferential direction.

With the rocking key provided with the plurality of to-be-pressed parts and with the plurality of to-be-pressed parts located at intervals along the circumferential direction, a plurality of different operations can be performed using the single rocking key.

Accordingly, a plurality of different operations can be performed through using the single rocking key, which ensures enhanced operability of the operation unit.

Thirdly, in the above-mentioned operation unit, desirably, the rotating dial is formed with an arrangement recessed part, the rotating dial is formed in a central portion thereof with an arrangement hole communicating with the arrangement recessed part, the push switch is arranged in the arrangement hole, and the rocking key is arranged in the arrangement recessed part in a state of covering the arrangement hole.

With the rocking key arranged in the arrangement recessed part of the rotating dial in the state of covering the arrangement hole, deposition of dust onto the push switch arranged in the arrangement hole is suppressed by the rocking key.

Accordingly, penetration of dust via the arrangement hole is restrained by the rocking key, and deposition of dust onto the push switch arranged in the arrangement hole is suppressed. Consequently, enhanced reliability of operation can be promised.

Fourthly, in the above-mentioned operation unit, desirably, the rotating dial is formed therein with an arrangement space extending in a circumferential direction around the reference axis, the rotating dial is formed with a gear portion extending in a circumferential direction around the reference axis, at least a part of an encoder is arranged in the arrangement space, and the encoder is provided with a rotating gear meshed with the gear portion.

With the rotating dial formed with the gear portion extending in the circumferential direction around the reference axis, with at least a part of the encoder arranged in the arrangement space, and with the encoder provided with the rotating gear meshed with the gear portion, the rotating gear of the encoder arranged in the arrangement space is rotated attendantly on the rotation of the rotating dial.

Accordingly, effective utilization of space can be realized, and alleviation of load on the encoder can be ensured, since the encoder is not rocked in this configuration.

Fifthly, in the above-mentioned operation unit, desirably, the rotating dial is provided with an outer circumferential part, an inner circumferential part located on an inside of the outer circumferential part and spaced from the outer circumferential part, and a connection part by which an end portion of the outer circumferential part and an end portion of the inner circumferential part are interconnected, the inner circumferential part is formed with the gear portion, and the arrangement space is formed between the outer circumferential part and the inner circumferential part.

With the rotating dial provided with the outer circumferential part and the inner circumferential part and the connection part, with the inner circumferential part formed with the gear portion, and with the arrangement space formed between the outer circumferential part and the inner circumferential part, the gear portion of the rotating dial is meshed with the rotating gear of the encoder arranged in the arrangement space.

Accordingly, effective utilization of the arrangement space can be ensured, while simplifying the structure of the rotating dial.

Sixthly, in the above-mentioned operation unit, desirably, the rocking key is formed in a central portion thereof with an insertion arrangement hole, a press key operated by being pressed is disposed in the insertion arrangement hole, and a push switch is arranged which outputs an operation signal by being pushed when the press key is operated.

With the press key arranged in the insertion arrangement hole formed in a central portion of the rocking key, and with the push switch arranged which outputs the operation signal by being pushed when the press key is operated, the rocking key and the press key are disposed on the inside of the rotating dial.

Accordingly, the operation unit including the three operating parts, namely, the rotating dial, the press key and the rocking key can be configured with a simple structure.

Seventhly, in the above-mentioned operation unit, desirably, the press key is moved between an initial position where it is located before operated by being pressed and a press position for pushing the push switch, an elastic member capable of elastic deformation is provided by which the press key is returned from the press position to the initial position when a pressing operation is released, and a sheet-formed rubber member oriented in an axial direction of the reference axis is used as the elastic member.

With the press key moved between the initial position where it is located before operated by being pressed and a press position for pushing the push switch, and with the sheet-formed rubber member (which is oriented in the axial direction of the reference axis) used as the elastic member capable of elastic deformation by which the press key is returned from the press position to the initial position, a biasing force in the direction from the press position toward the initial position is exerted on the press key by the rubber member at the time of a pressing operation.

Accordingly, the arrangement space for the elastic member may be small. Besides, simplification of the structure of the operation unit and thinning of the operation unit in the axial direction can be ensured.

Eighthly, in the above-mentioned operation unit, desirably, the press key is moved between an initial position where it is located before operated by being pressed and a press position for pushing the push switch, an elastic member capable of elastic deformation is provided by which the press key is returned from the press position to the initial position when a pressing operation is released, and a helical compression spring expanded and contracted in an axial direction of the reference axis is used as the elastic member.

With the press key moved between the initial position where it is located before operated by being pressed and the press position for pushing the push switch, and with the helical compression spring (which is expanded and contracted in the axial direction of the reference axis) used as the elastic member capable of elastic deformation by which the press key is returned from the press position to the initial position, a biasing force in the direction from the press position toward the initial position is exerted on the press key by the helical compression spring.

Accordingly, the structure of the operation unit can be simplified and the manufacturing cost can be cut down.

Ninthly, in the above-mentioned operation unit, desirably, the rocking key is moved between a non-operation position where it is located before operated by being pressed and an operation position for pushing the push switch, an elastic member capable of elastic deformation is provided by which the rocking key is returned from the operation position to the non-operation position when a pressing operation is released, and a sheet-formed rubber member oriented in an axial direction of the reference axis is used as the elastic member.

With the rocking key moved between the non-operation position where it is located before operated by being pressed and the operation position for pushing the push switch, and with the sheet-formed rubber member (which is oriented in the axial direction of the reference axis) used as the elastic member capable of elastic deformation by which the rocking key is returned from the operation position to the non-operation position, a biasing force in the direction from the operation position toward the non-operation position is exerted on the rocking key by the rubber member at the time of a pressing operation.

Accordingly, the arrangement space for the elastic member may be small. In addition, simplification of the structure of the operation unit and thinning of the operation unit in the axial direction can be promised.

Tenthly, in the above-mentioned operation unit, desirably, the rocking key is formed in a central portion thereof with an insertion arrangement hole, a press key operated by being pressed is disposed in the insertion arrangement hole, a push switch is provided which outputs an operation signal by being pushed when the press key is operated, the press key is moved between an initial position where it is located before operated by being pressed and a press position for pushing the push switch, and the rubber member is used as an elastic member capable of elastic deformation by which the press key is returned from the press position to the initial position when a pressing operation is released.

With the press key arranged in the insertion arrangement hole formed in a central portion of the rocking key, and with the sheet-formed rubber member (which is oriented in the axial direction of the reference axis) used as the elastic member capable of elastic deformation by which the press key is returned from the press position to the initial position, a biasing force in the direction from the press position toward the initial position is exerted on the press key by the rubber member at the time of a pressing operation.

Accordingly, the operation unit can be reduced in the number of component parts and can be simplified in mechanism.

Eleventhly, in the above-mentioned operation unit, desirably, the rocking key is moved between a non-operation position where it is located before operated by being pressed and an operation position where it is located when operated by being pressed, an elastic member capable of elastic deformation is provided by which the rocking key is returned from the operation position to the non-operation position when a pressing operation is released, and a helical compression spring expanded and contracted in an axial direction of the reference axis is used as the elastic member.

With the rocking key moved between the non-operation position where it is located before operated by being pressed and the operation position where it is located when operated by being pressed, and with the helical compression spring (which is expanded and contracted in the axial direction of the reference axis) used as the elastic member capable of elastic deformation by which the rocking key is returned from the operation position to the non-operation position, a biasing force in the direction from the operation position toward the non-operation position is exerted on the rocking key by the helical compression spring.

Accordingly, the operation unit can be simplified in structure and the manufacturing cost thereof can be reduced.

Twelfthly, in the above-mentioned operation unit, desirably, the rocking key is formed in a central portion thereof with an insertion arrangement hole, a press key operated by being pressed is disposed in the insertion arrangement hole, a push switch is provided which outputs an operation signal by being pushed when the press key is operated, the press key is moved between an initial position where it is located before operated by being pressed and a press position for pushing the push switch, an elastic member capable of elastic deformation is provided by which the press key is returned from the press position to the initial position when a pressing operation is released, a helical compression spring expanded and contracted in an axial direction of the reference axis is used as the elastic member, and the helical compression spring by which the rocking key is returned from the operation position to the non-operation position and the helical compression spring by which the press key is returned from the press position to the initial position are arranged coaxially.

With the helical compression spring for returning the rocking key from the operation position to the non-operation position and the helical compression spring for returning the press key from the press position to the initial position being arranged coaxially, the space for arrangement of the elastic members is reduced.

Accordingly, thinning of the operation unit in the axial direction can be realized through enhancement of space efficiency.

In order to solve the above-mentioned problems, according to another embodiment of the present technology, there is provided an electronic apparatus including an operation unit and a main body operated according to an operation on the operation unit, wherein the operation unit includes: a rotating dial operated by being rotated about a predetermined reference axis; a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated; and wherein the rocking key is inclined when the to-be-pressed part is operated by being pressed, in such a manner that a position on a roughly 180° opposite side of the reference axis from the to-be-pressed part serves as a fulcrum.

According to the electronic apparatus, therefore, the rocking key is inclined with the position on the roughly 180° opposite side of the reference axis from the to-be-pressed part as the fulcrum, whereby the push switch is pushed.

Accordingly, even where the operation unit is enlarged, the to-be-operated part is less liable to make contact with other part of the operation unit when the rocking key is rocked. Besides, in the electronic apparatus, enhanced operability and enhanced reliability of operation can be ensured through enlargement of the operation unit.

DETAILED DESCRIPTION OF THE PREFERRED EMBODIMENTS

Now, a best mode for carrying out an operation unit and an electronic apparatus according to an embodiment of the present technology will be described below, referring to the accompanying drawings.

In the best mode described below, the electronic apparatus according to an embodiment of the present technology is applied to an acoustic apparatus having a speaker, and the operation unit according to an embodiment of the present technology is applied to an operation unit provided in the acoustic apparatus.

It should be noted here, however, that the application range of the present technology is not limited to the acoustic apparatus and the operation unit provided therein; thus, the technology is applicable to a variety of other electronic apparatuses, for example, recording/reproduction devices using recording media such as disk recording/reproduction devices, sound recording/reproduction devices for recording and reproducing sounds, imaging devices for picking up still or video images, network communication devices for unidirectional or bidirectional transmission and reception, and information processing devices such as personal computers and PDAs (Personal Digital Assistants). In addition, the operation unit according to an embodiment of the present technology is applicable widely to operation units provided in these various electronic apparatuses.

In the following description, forward and backward, upward and downward, and leftward and rightward directions will be designated by taking the direction in which the speaker is oriented as the forward direction. Incidentally, the forward and backward, upward and downward, and leftward and rightward directions shown below are merely for convenience of description, and these directions are not restrictive in carrying out the present technology.

General Configuration of Electronic Apparatus

Figure 1:
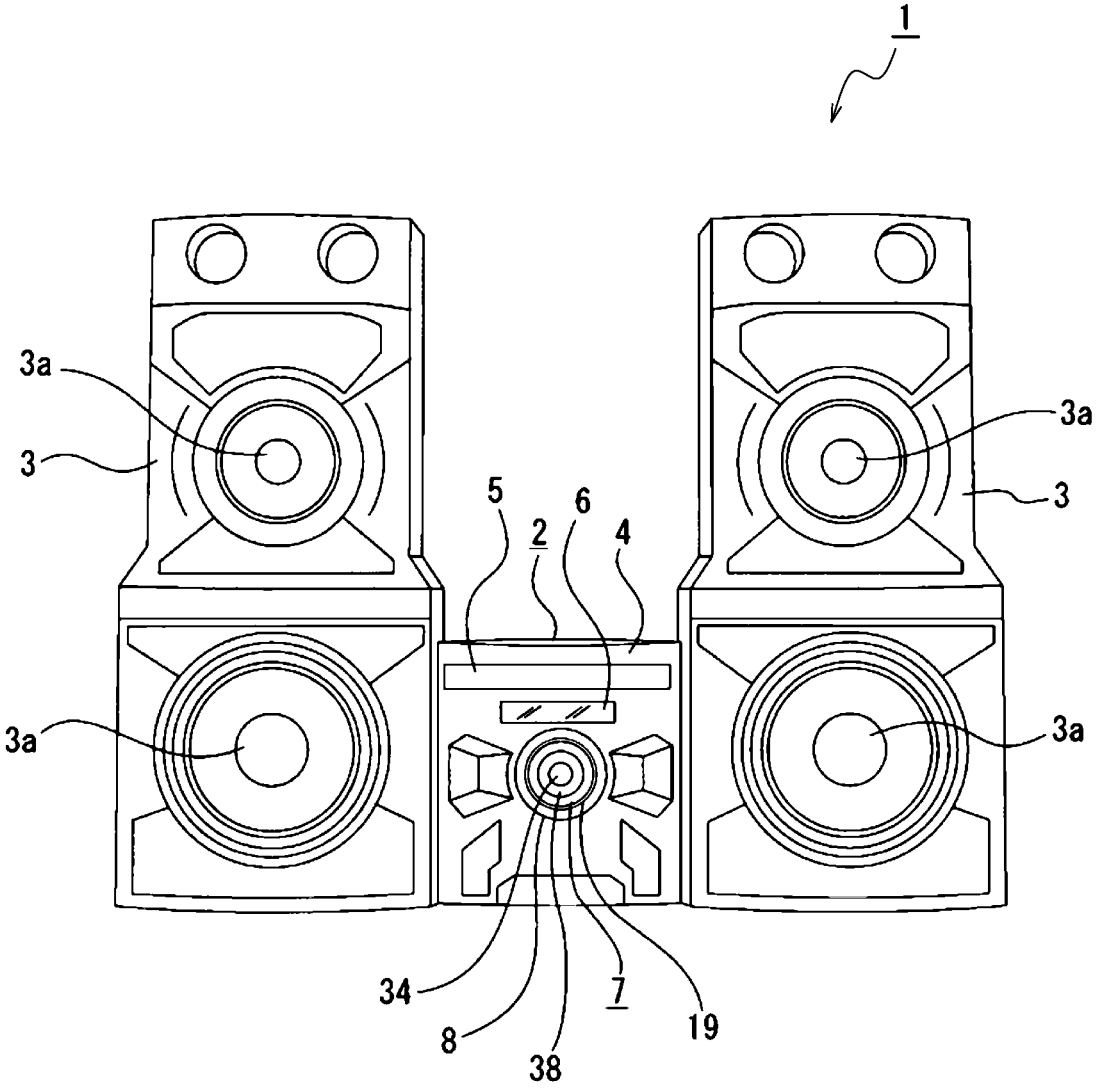
FIG. 1, together with FIGS. 2 to 7, illustrates a first embodiment of an operation unit and an electronic apparatus according to an embodiment of the present technology, and is a front view of the electronic apparatus.
Figure 2:
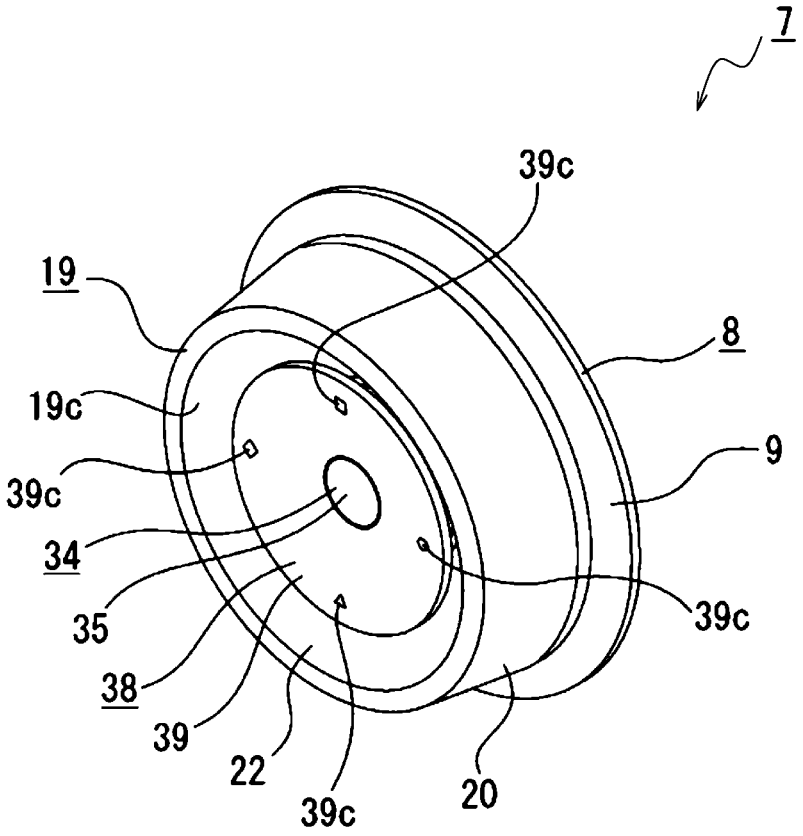
FIG. 2 is a perspective view of the operation unit.
Figure 3:
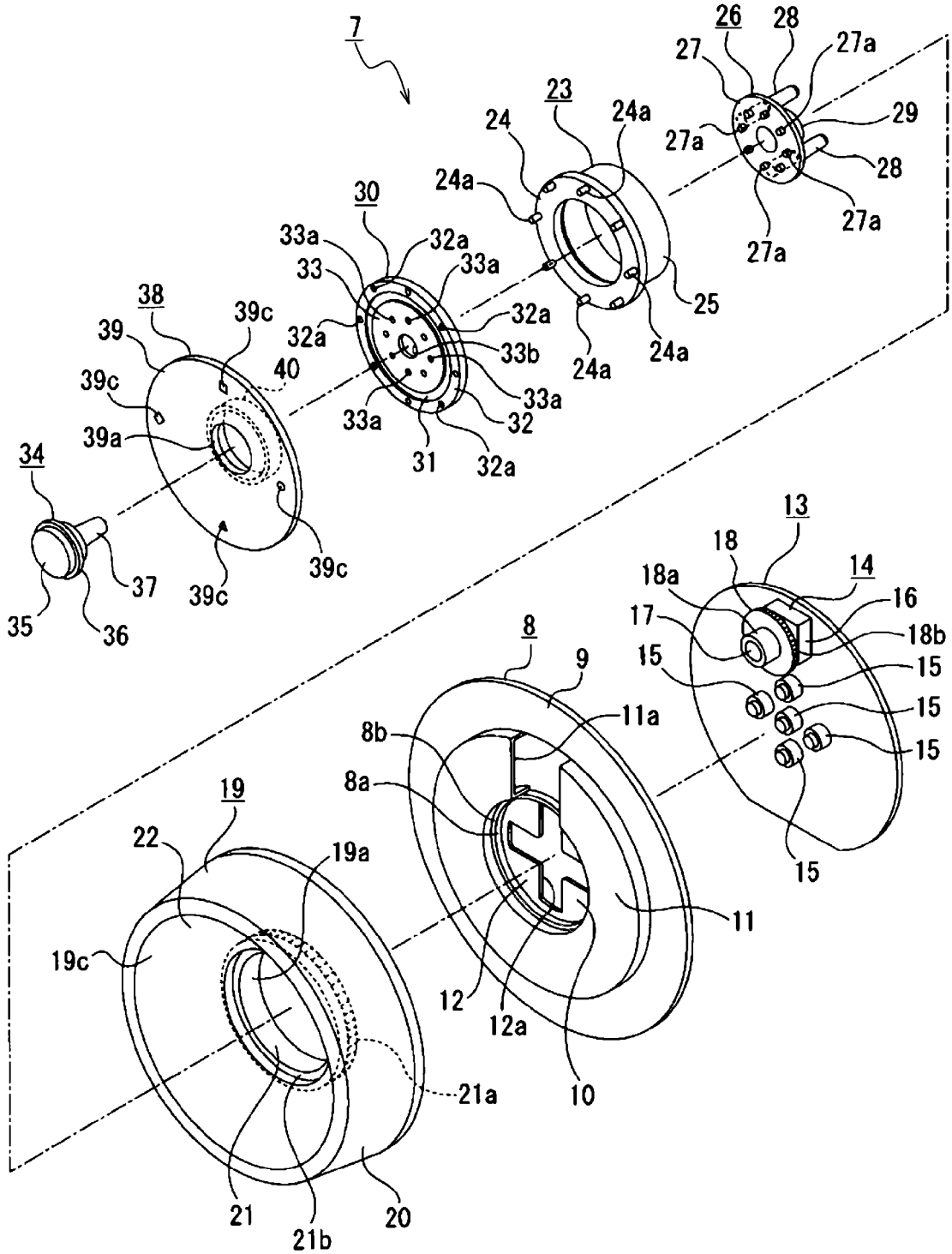
FIG. 3 is an exploded perspective view of the operation unit.

An electronic apparatus (acoustic device) 1, as shown in FIG. 1, includes a main body 2 and a pair of speaker units 3, 3 disposed on the left and right sides of the main body 2. The speaker units 3, 3 are each provided with sound output parts 3*a*, 3*a*, . . . which are vertically spaced from one another, and sounds in predetermined bands are outputted respectively from the sound output parts 3*a*, 3*a*, . . . .

The main body 2 has desired parts disposed in a housing 4.

In an upper end portion of the housing 4, a tray 5 is supported so as to be movable in the forward-backward direction. The tray 5 is movable between a position in which it is contained in the housing 4 and a position in which it has been drawn out of the housing 4. In the condition where the tray 5 has been drawn out of the housing 4, a recording disk (not shown) can be mounted thereon. When the tray 5 with a recording disk mounted thereon is contained into the housing 4, playback (reproduction) of music data recorded on the recording disk can be performed.

A display section 6 is provided at a front surface of the housing 4. Current operating conditions of the electronic apparatus 1, operating conditions of the operation unit (described later), and the like are displayed on the display section 6.

Configuration of Operation Unit

Now, a first embodiment of the operation unit will be described below (see FIGS. 1 to 7).

An operation unit 7 is disposed at a central portion of the front surface of the housing 4. The operation unit 7 has desired parts disposed on a base plate 8 oriented in the forward-backward direction (see FIGS. 2 to 4).

The base plate 8 is circular in outer shape, and includes an annular outside part 9 and an inside part 10 located on the inside of the outside part 9.

The inside part 10 includes an annular projected portion 11 and a central portion 12 located on the inside of the projected portion 11. The projected portion 11 is located slightly on the front side of the outside part 9, and the central portion 12 is located on the same plane as the outside part 9. The projected portion 11 is formed with an insertion arrangement hole 11*a*. The central portion 12 is formed with a cross-shaped switch arrangement hole 12*a*.

Of the central portion 12 of the base plate 8, a front surface of an outer circumferential portion is formed as a mounting surface 8*a*, and a front surface of a portion continuous with and on the outside of the mounting surface 8*a* is formed as a sliding surface 8*b*. The sliding surface 8*b* is located on the front side relative to the mounting surface 8*a*.

A circuit board 13 is attached to a back surface of the base plate 8. An encoder 14 and push switches 15, 15, . . . are mounted on a front surface of the circuit board 13.

The encoder 14 includes a base body part 16 attached to the circuit board 13, a rotating shaft 17 projected forward from the base body part 16, and a rotating gear 18 attached to the rotating shaft 17. The rotating gear 18 has a hollow cylindrical to-be-attached part 18*a*, and a gear part 18*b* protruded outward from the to-be-attached part 18*a*. The rotating gear 18 is attached to the rotating shaft by fitting the to-be-attached part 18*a* to the rotating shaft 17.

The encoder 14 is mounted on an outer circumferential portion of the circuit board 13, and is disposed in the insertion arrangement hole 11*a* in the base plate 8, with the rotating gear 18 located on the front side of the base plate 8.

The push switches 15, 15, . . . are mounted on the circuit board 13 in the manner of being arranged on a central portion and on the upper, lower, left and right sides the central portion, of the circuit board 13. The push switches 15, 15, . . . are disposed in the switch arrangement hole 12*a* in the base plate 8.

A rotating dial 19 is rotatably supported on the base plate 8, on the front side of the latter. The rotating dial 19 includes a roughly hollow-cylindrical outer circumferential part 20 having an axis set in the forward-backward direction, a roughly hollow-cylindrical inner circumferential part 21 located on the inside of the outer circumferential part 20 and having an axis set in the forward-backward direction, and a connection part 22 by which a front end portion of the outer circumferential part 20 and a front end portion of the inner circumferential part 21 are interconnected.

The front end portion of the inner circumferential part 21 is located on the back side relative to the front end portion of the outer circumferential part 20. A surface, facing the outer circumferential part 20, of the inner circumferential part 21 is formed with a gear portion 21*a* extending in the circumferential direction. A front end surface of the inner circumferential part 21 is formed as a to-be-held surface 21*b*.

A space on the inside of the inner circumferential part 21 of the rotating dial 19 is formed as an arrangement hole 19*a*. A space defined by the outer circumferential part 20 and the inner circumferential part 21 and the connection part 22 of the rotating dial 19 is formed as an arrangement space 19*b*.

The connection part 22 is formed in a spherical surface shape, and the rotating dial 19 is formed with an arrangement concave part (arrangement recessed part) 19*c* opening forward by the connection part 22.

The rotating dial 19 is rotatably supported on the base plate 8, with a back end surface of its inner circumferential part 21 in contact with the sliding surface 8*b*. An axis of rotation in an rotating operation of the rotating dial 19 is made to be a reference axis P. The reference axis P coincides with a center axis of the push switch 15 that is mounted on the central portion of the base plate 8.

In the condition where the rotating dial 19 is supported on the base plate 8, a part of the encoder 14 is arranged in the arrangement space 19*b*, and the gear part 18*b* of the rotating gear 18 is meshed with the gear portion 21*a* of the rotating dial 19. When the rotating dial 19 is rotated about the reference axis P, therefore, the rotating gear 18 is rotated as one body with the rotating shaft 17, and the rotating direction and rotation amount of the rotating dial 19 are detected based on the rotating direction and rotation amount of the rotating shaft 17.

A support base 23 is mounted to the base plate 8. The support base 23 includes an annular holding plate part 24, and a hollow cylindrical tube part 25 projected backward from the holding plate part 24. The tube part 25 is projected from a portion, other than an outer circumferential portion and an inner circumferential portion, of a back surface of the holding plate part 24.

The holding plate part 24 is provided with fitting pins 24*a*, 24*a*, . . . which are projected forward and are spaced apart at regular intervals along the circumferential direction. The outer circumferential portion of the back surface of the holding plate part 24 is formed as a holding surface 24*b*.

The support base 23 is mounted to the base plate 8 by a structure in which a back end surface of the tube part 25 is fixed to the mounting surface 8*a* by an adhesive or the like. In a condition where the support base 23 is mounted to the base plate 8, the to-be-held surface 21*b* of the rotating dial 19 is held (pressed) from the front side by the holding surface 24*b*, whereby the rotating dial 19 is prevented from slipping off the base plate 8.

A pushing member 26 is disposed on the inside of the support base 23. The pushing member 26 includes a base part 27 formed in an annular shape, pushing projections 28, 28, . . . projected backward from an outer circumferential portion of the base part 27, and a roughly hollow-cylindrical circumferential surface part 29 projected backward from an inner circumferential portion of the base part 27.

The base part 27 is provided with fitting-in pins 27*a*, 27*a*, . . . which are projected forward and are spaced apart at regular intervals along the circumferential direction.

The pushing projections 28, 28, . . . are each formed in a shaft-like shape, and are provided in four at regular intervals along the circumferential direction.

A rubber member 30 functioning as an elastic member is attached to the support base 23 and the pushing member 26.

The rubber member 30 is formed in a roughly circular disk-like shape, and a portion near the outer circumference thereof is provided as a thin part 31 that is thinner than the other portions. Of the rubber member 30, the portion on the outside of the thin part 31 is provided as a non-deformation part 32, whereas the portion on the inside of the thin part 31 is provided as a deformation part 33 which is elastically deformable.

The non-deformation part 32 is formed with fitting holes 32*a*, 32*a*, . . . , which are spaced apart at regular intervals along the circumferential direction.

The deformation part 33 is formed with fitting-in holes 33*a*, 33*a*, . . . , which are located at regular intervals along the circumferential direction. The deformation part 33 is formed in a central portion thereof with a shaft insertion hole 33*b*.

The rubber member 30 is attached to the support base 23 and the pushing member 26 by a structure in which the fitting pins 24*a*, 24*a*, . . . of the support base 23 are press fitted respectively into the fitting holes 32*a*, 32*a*, . . . from the back side and the fitting-in pins 27*a*, 27*a*, . . . of the pushing member 26 are press fitted respectively into the fitting-in holes 33*a*, 33*a*, . . . .

Of the rubber member 30, the thin part 31 functions as a hinge part, whereas the deformation part 33 is elastically deformable in relation to the non-deformation part 32.

In the condition where the rubber member 30 is attached to the support base 23 and the pushing member 26, back end surfaces of the pushing projections 28, 28, . . . of the pushing member 26 are located on the front side of and in the vicinity of the push switches 15, 15, . . . , respectively. The pushing member 26 is moved in the forward-backward direction as the rubber member 30 is elastically deformed.

A press key 34 is inserted in the shaft insertion hole 33*b* in the rubber member 30. The press key 34 includes a to-be-acted part 35 formed in a roughly cylindrical shape, a flange part 36 projected outward from a position near the front end of the to-be-acted part 35, and a shaft part 37 projected backward from the to-be-acted part 35.

Of the press key 34, the shaft part 37 is projected from a portion, other than an outer circumferential portion, of the to-be-acted part 35. An outer circumferential portion of a back surface of the to-be-acted part 35 is formed as a pressure contact surface 35*a*.

Of the press key 34, the shaft part 37 is passed sequentially through the shaft insertion hole 33*b* in the rubber member 30 and the circumferential surface part 29 of the pushing member 26 from the front side, and a back end portion of the shaft part 37 is projected backward from the circumferential surface part 29. In this case, of the press key 34, the pressure contact surface 35*a* is pressed against the front surface of the rubber member 30, and a back end surface of the shaft part 37 is located on the front side of and in the vicinity of the push switch 15.

A rocking key 38 is attached to the front surface of the rubber member 30. The rocking key 38 includes a to-be-operated part 39 formed in a recessed (concave) shape opening to the front side, and a hollow cylindrical pressing tube part 40 projected backward from the to-be-operated part 39.

The to-be-operated part 39 is circular in outer shape, and is provided in a central portion thereof with an insertion arrangement hole 39*a*. The to-be-operated part 39 is formed in a roughly spherical surface shape. An inner circumferential portion of a back surface of the to-be-operated part 39 is formed as a restriction surface 39*b*. A front surface of the to-be-operated part 39 is formed with four to-be-pressed parts 39*c*, 39*c*, . . . spaced apart at regular intervals along the circumferential direction.

The pressing tube part 40 is projected from a position slightly on the outside of the insertion arrangement hole 39*a* of the to-be-operated part 39.

The rocking key 38 is attached to the rubber member 30 by fixing a back end surface of its pressing tube part 40 to a position near the outer circumference of the deformation part 33 by an adhesive or the like. In the condition where the rocking key 38 is attached to the rubber member 30, the restriction surface 39*b* of the rocking key 38 is in contact with the flange part 36 of the press key 34, whereby forward movement of the press key 34 is restricted.

Of the rocking key 38, the to-be-operated part 39 is located in the arrangement concave part 19*c* formed in the rotating dial 19, and the to-be-operated part 39 is set in the state of covering the arrangement hole 19*a* in the rotating dial 19 on the front side of the latter.

Operation of Operation Unit

Now, operations of the operation unit 7 will be described below (see FIGS. 4 to 7).

In the first place, the operation when the rotating dial 19 is operated will be described.

When the rotating dial 19 is operated by being rotated, the rotating gear 18 in mesh with the gear part 18*b* of the encoder 14 is rotated as one body with the rotating shaft 17, attendant on the rotation of the rotating dial 19, and the rotating direction and rotation amount of the rotating dial 19 are detected based on the rotating direction and rotation amount of the rotating shaft 17.

When the rotating direction and rotation amount of the rotating dial 19 are detected, for example, the magnitude of the sound outputted from each of the sound output parts 3*a*, 3*a*, . . . of the speaker units 3, 3 is changed according to the results of detection.

In the next place, the operation when the rocking key 38 is operated will be described (see FIGS. 4 to 6).

Figure 4:
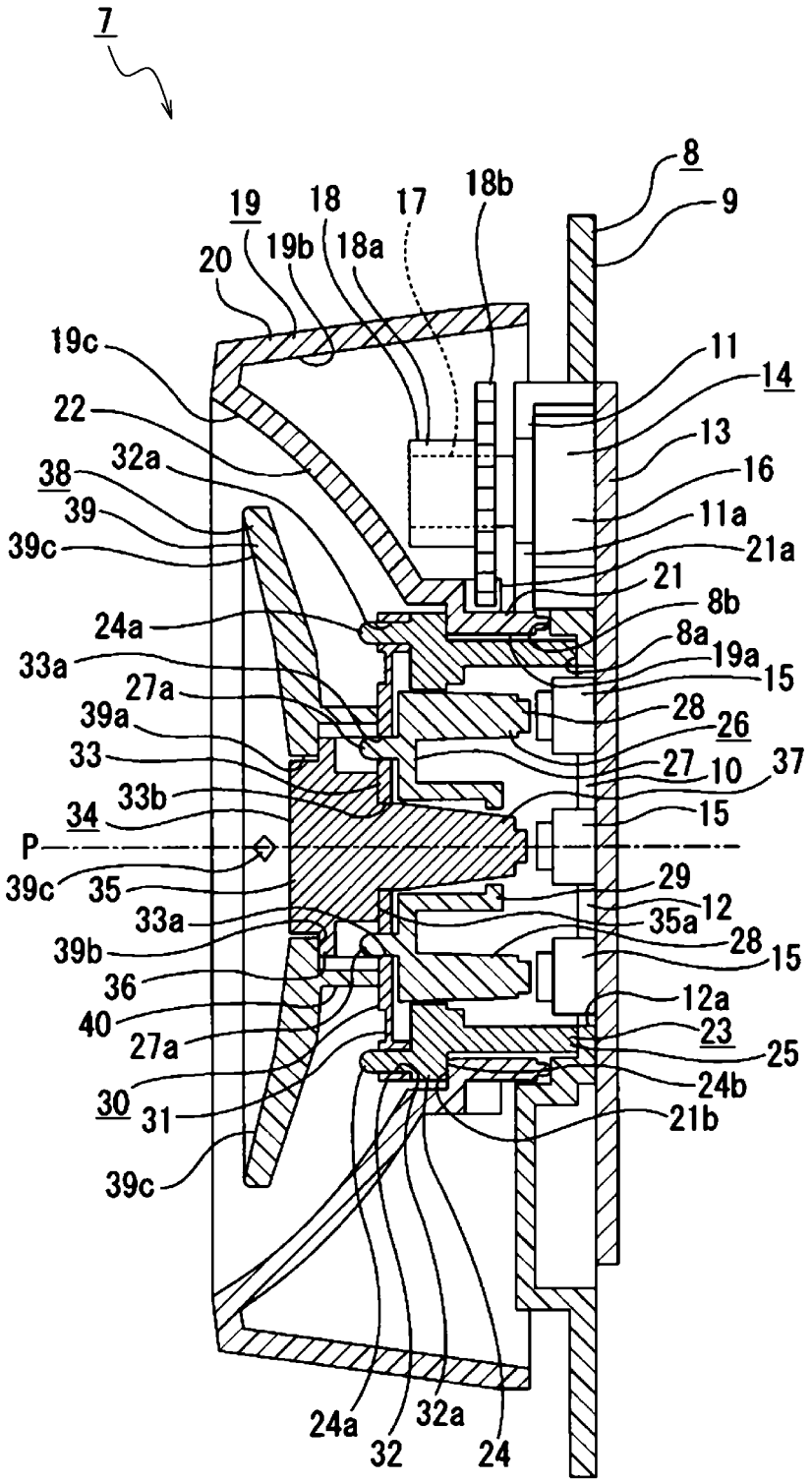
FIG. 4 is an enlarged sectional view of the operation unit.

When the rocking key 38 is in a non-operation position before being operated, the rocking key 38 is in a symmetric state with the reference axis P as the center of symmetry, and the deformation part 33 of the rubber member 30 is not in a deformed state (see FIG. 4).

Figure 5:
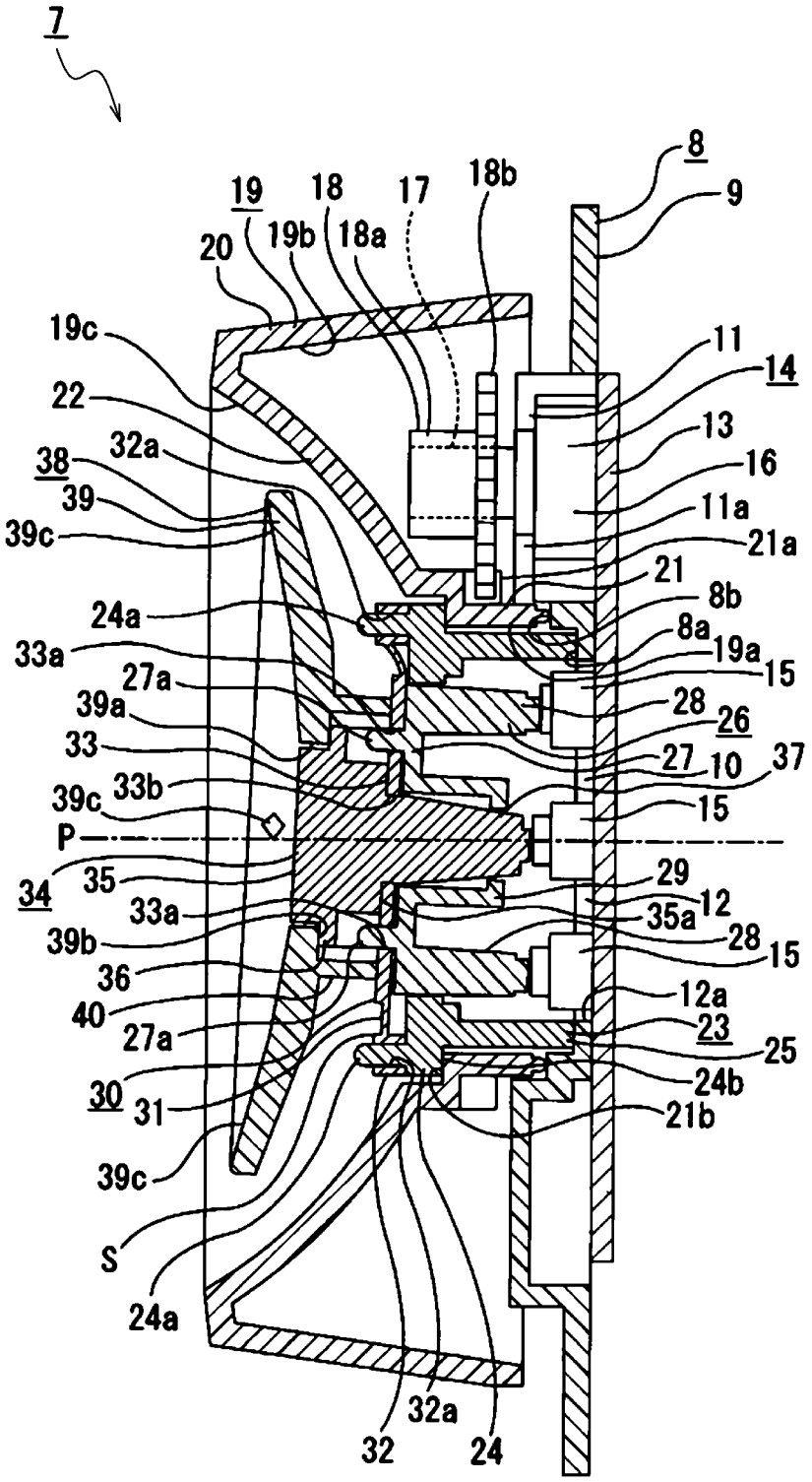
FIG. 5 is an enlarged sectional view showing a condition where a rocking key is operated.

When one of the to-be-pressed parts 39*c* of the rocking key 38 is pressed, the rocking key 38 is rocked toward an operation position relative to the reference axis P (see FIG. 5). In this instance, the deformation part 33 of the rubber member 30 is pressed by the pressing tube part 40 of the rocking key 38 from the front side, to be elastically deformed. The rocking key 38 is rocked in such a manner that that portion S of the non-deformation part 32 which is present on the opposite side of the reference axis P from the to-be-pressed part 39*c* now pressed serves as a fulcrum.

When the rocking key 38 is rocked and the deformation part 33 of the rubber member 30 is elastically deformed, the pushing member 26 is inclined relative to the reference axis P attendantly on the deformation of the deformation part 33, and the push switch 15 is pushed by the pushing projection 28 located just on the back side of the to-be-pressed part 39*c* now pressed. With the push switch 15 thus pushed, an operation signal is outputted, whereby it is enabled to carry out a predetermined processing such as, for example, tune selection on music data, fast-forward feeding, rewinding, or movement to other data folder.

When the pressing on the to-be-pressed part 39*c* having been pressed is released, the deformation part 33 of the rubber member 30 is elastically returned to the original form, and the pushing member 26 and the rocking key 38 are returned into their non-operation positions where they have been before operated (see FIG. 4).

Figure 6:
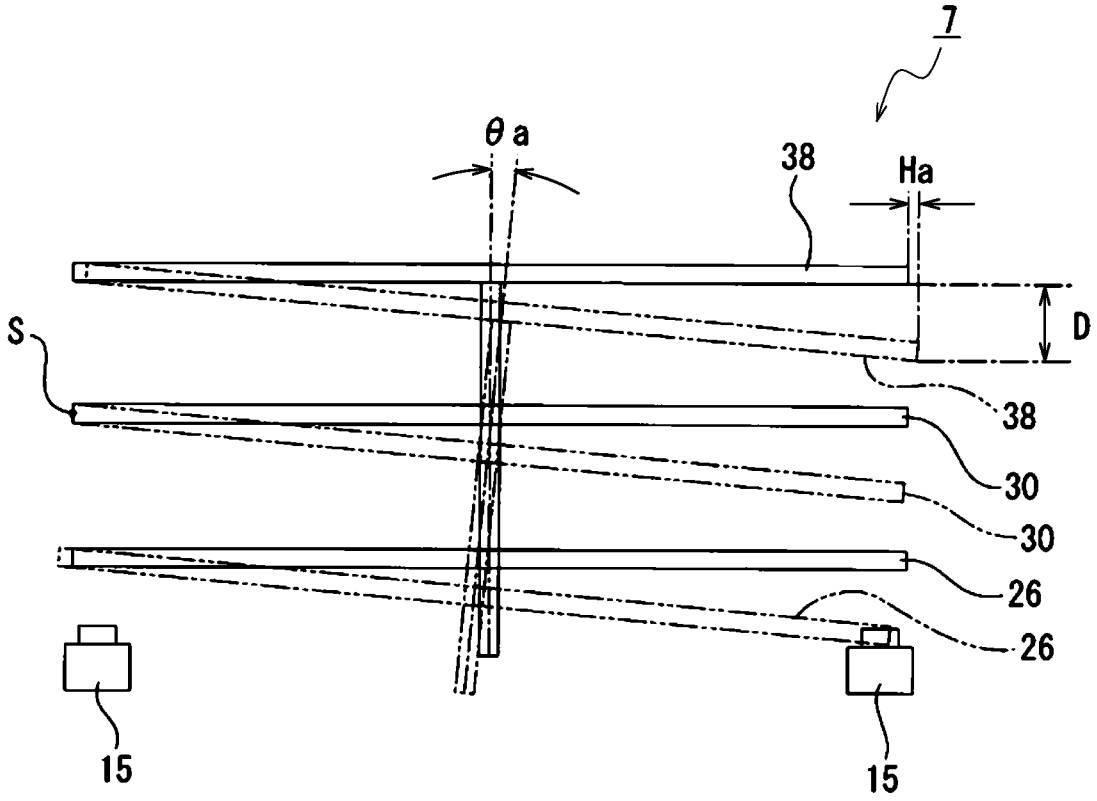
FIG. 6 is a schematic view for illustrating an inclination angle and a displacement when the rocking key is operated.

FIG. 6 is a schematic view for illustrating an operation state when the rocking key 38 is rocked with the portion S as a fulcrum. In FIG. 6, for easy description, the operation unit 7 has a configuration obtained by adding the rubber member 30 to the same configuration as that in FIG. 12.

Figure 12:
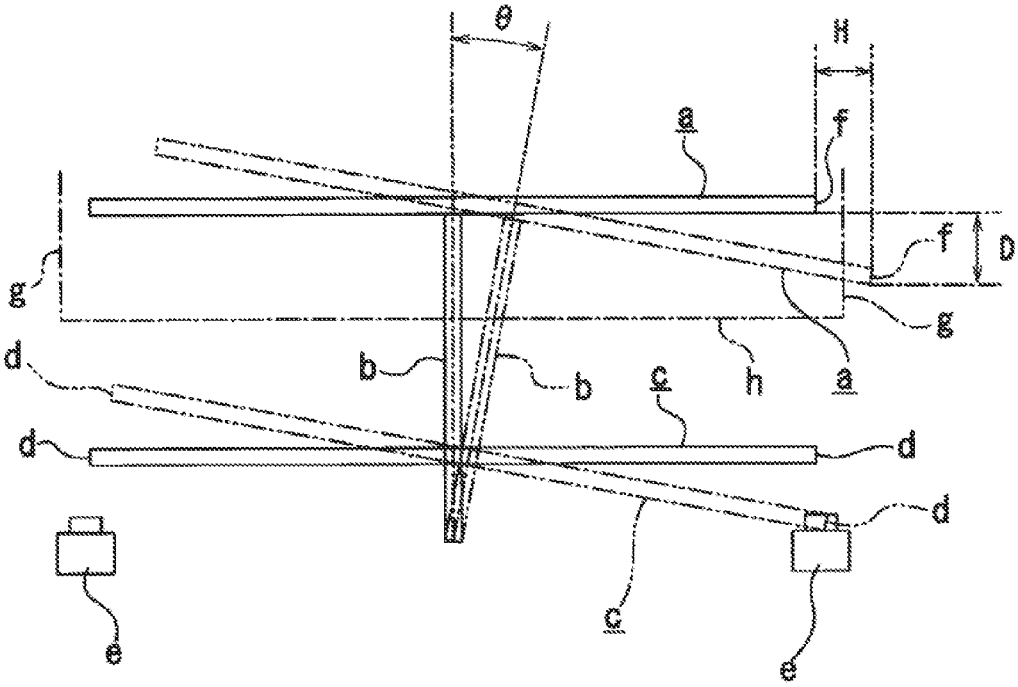
FIG. 12 (PRIOR ART)
FIG. 12 is a schematic view for illustrating an inclination angle and a displacement when a rocking operation is conducted in an operation unit according to a related art.

Like FIG. 12, FIG. 6 shows a state in which the rocking key 38 is rocked according to the length of a moving distance D required for the pushing member 26 to push the push switch 15. The rocking key 38 is now rocked with the portion S as a fulcrum, and the inclination angle θa is smaller than the inclination angle θ shown in FIG. 12 which is reached when the rocking key 38 is rocked with the reference axis as a fulcrum. In addition, the displacement Ha in a direction orthogonal to the moving distance D is also smaller than the displacement H shown in FIG. 12.

In the operation unit 7, therefore, the inclination angle θa and the displacement Ha of the rocking key 38 can be reduced, while securing the moving distance D necessary for the pushing member 26 to push the push switch 15.

In the next place, operation when the press key 34 is operated will be described (see FIGS. 4 and 7).

In a state before the press key 34 is operated, the deformation part 33 of the rubber member 30 is not in a deformed state (see FIG. 4).

Figure 7:
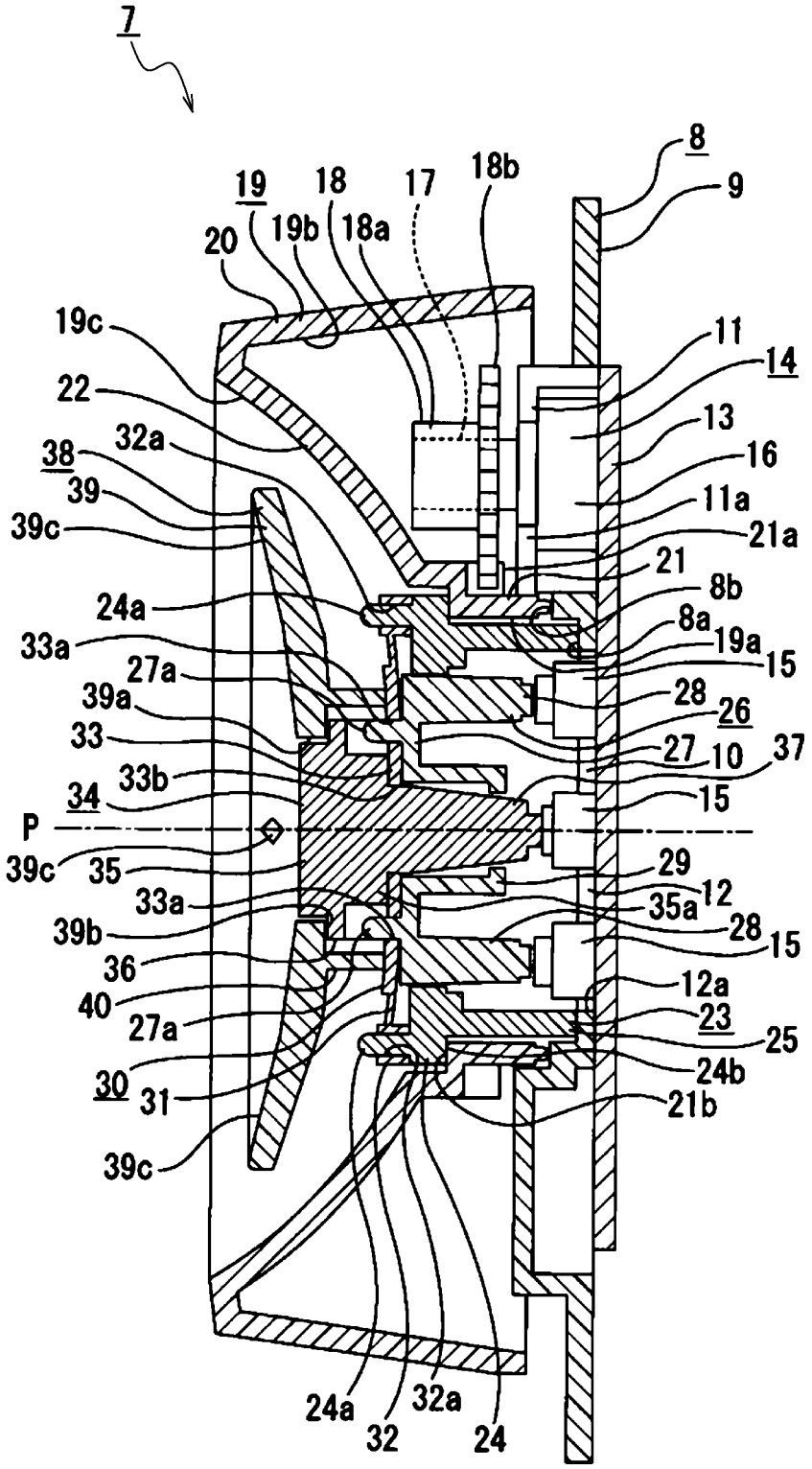
FIG. 7 is an enlarged sectional view showing a condition where a press key is operated.
Figure 8:
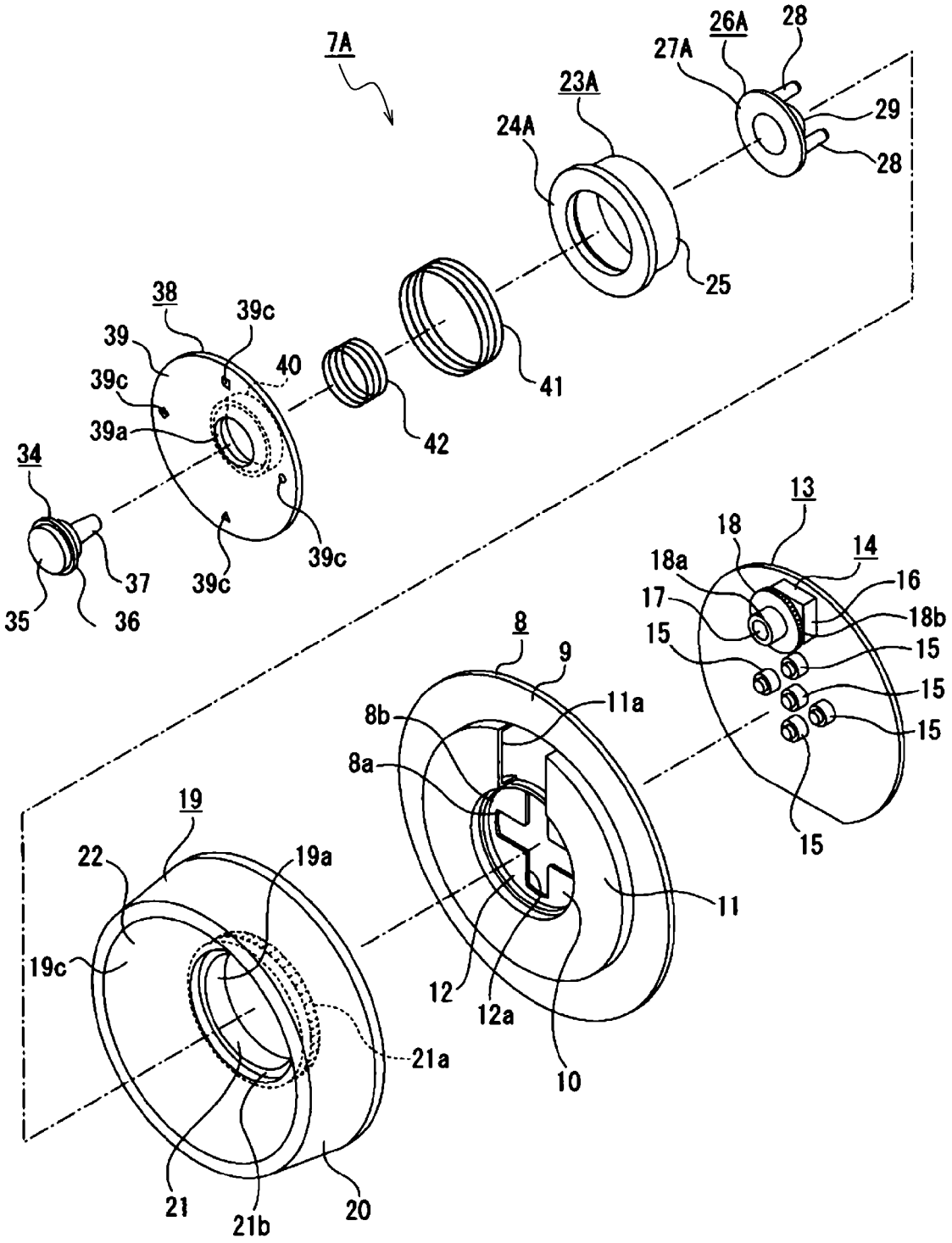
FIG. 8, together with FIGS. 9 to 11, illustrates a second embodiment of an operation unit, and is an exploded perspective view.

When the to-be-acted part 35 of the press key 34 is operated by being pressed, the press key 34 is moved backward from its initial position (where it has been located before operated) toward a press position for pushing the push switch 15 (see FIG. 7). In this instance, the deformation part 33 of the rubber member 30 is pressed by the to-be-acted part 35 of the press key 34 from the front side, to be elastically deformed.

When the press key 34 is moved, the push switch 15 is pushed by the shaft part 37. With the push switch 15 pushed, an operation signal is outputted, and a predetermined processing, for example, a determination operation such as tune selection on music data or movement to other data folder, that is designated by an operation of the rotating dial 19, is carried out.

When the pressing on the to-be-acted part 35 having been pressed is released, the deformation part 33 of the rubber member 30 is elastically returned, and the press key 34 is returned into its initial position where it has been located before operated (see FIG. 4).

As above-mentioned, in the operation unit 7, the sheet-formed rubber member 30 is used as an elastic member capable of elastic deformation by which the rocking key 38 is returned from the operation position to the non-operation position.

Accordingly, the space for arrangement of the elastic member may be small, and simplification of the structure of the operation unit 7 and thinning of the operation unit 7 in the axial direction (forward-backward direction) can be promised.

Besides, in the operation unit 7, the sheet-formed rubber member 30 is used as an elastic member capable of elastic deformation by which the press key 34 is returned from the press position to the initial position.

Accordingly, the space for arrangement of the elastic member may be small, and simplification of the structure of the operation unit 7 and thinning of the operation unit 7 in the axial direction (forward-backward direction) can be promised.

Furthermore, the same rubber member 30 is used as an elastic member capable of elastic deformation by which the rocking key 38 is returned from the operation position to the non-operation position and by which the press key 34 is returned from the press position to the initial position.

Consequently, a reduction in the number of component parts of the operation unit 7 and simplification of the structure of the operation unit 7 can be ensured.

Second Embodiment of Operation Unit

Now, a second embodiment of the operation unit will be described below (see FIGS. 8 to 11).

Incidentally, an operation unit 7A according to the second embodiment as follows differs from the above-described operation unit 7 only in the configuration of the elastic member and in the configurations of other component parts influenced by the difference in the configuration of the elastic member. In view of this, only that part of the operation unit 7A which is different from the corresponding part of the operation unit 7 will be described in detail, whereas the other parts will be denoted by the same reference signs as used for the corresponding parts of the operation unit 7 and their descriptions will be omitted.

A support base 23A is attached to a base plate 8. The support base 23A includes an annular holding plate part 24A and a tube part 25. Unlike the holding plate part 24, the holding plate part 24A is not provided with fitting pins 24*a*, 24*a*, . . . .

A pushing member 26A is disposed on the inside of the support base 23A. The pushing member 26A has an annular base part 27A, pushing projections 28, 28, . . . , and a circumferential surface part 29.

Unlike the base part 27, the base part 27A is not provided with fitting-in pins 27*a*, 27*a*, . . . .

A first helical compression spring 41 functioning as an elastic member is disposed between the support base 23A and a rocking key 38. Specifically, the first helical compression spring 41 is disposed between the holding plate part 24A of the support base 23A and an to-be-operated part 39 of the rocking key 38. Therefore, the rocking key 38 is biased forward by the first helical compression spring 41.

A second helical compression spring 42 functioning as an elastic member is disposed between the pushing member 26A and a press key 34. Specifically, the second helical compression spring 42 is disposed between the base part 27A of the pushing member 26A and a flange part 36 of the press key 34. Accordingly, the press key 34 is biased forward by the second helical compression spring 42.

The rocking key 38 is attached to the pushing member 26A by fixing a back end surface of a pressing tube part 40 to a front surface of the base part 27A by an adhesive or the like.

Now, operations of the operation unit 7A will be described below (see FIGS. 9 to 11).

The operation when a rotating dial 19 is operated is the same as the operation when the rotating dial 19 in the operation unit 7 is operated; therefore, the description of this operation is omitted.

Figure 10:
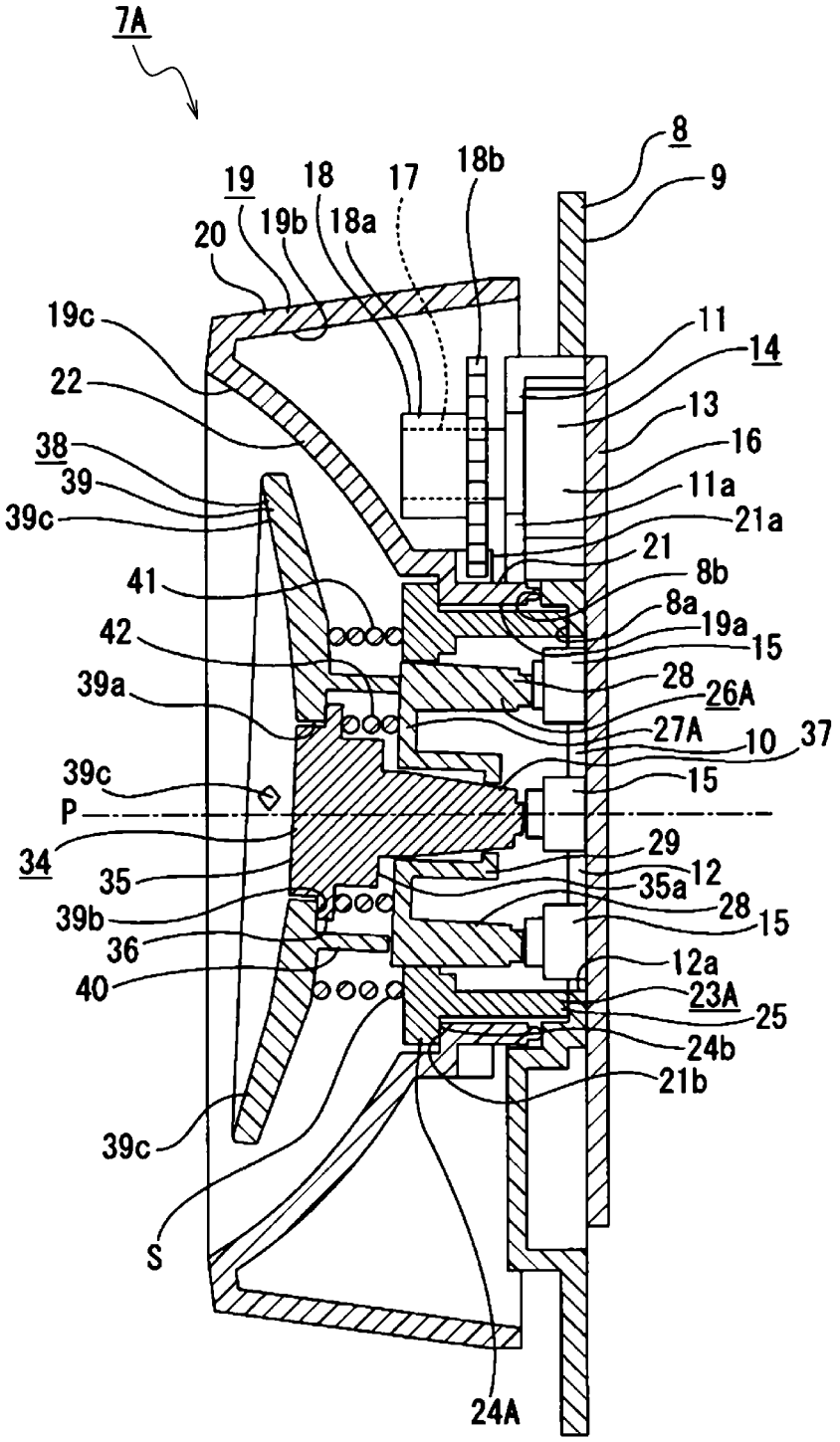
FIG. 10 is an enlarged sectional view showing a condition where a rocking key is operated.

When one of to-be-pressed parts 39*c* of the rocking key 38 is pressed, the rocking key 38 is rocked toward an operation position in relation to a reference axis P (see FIG. 10). In this instance, the first helical compression spring 41 is pressed by the to-be-operated part 39 of the rocking key from the front side, to be elastically deformed. The rocking key 38 is rocked in such a manner that a lower end portion S of the first helical compression spring 41 present on the opposite side of the reference axis P from the to-be-pressed part 39*c* now pressed serves as a fulcrum.

When the rocking key 38 is rocked and the first helical compression spring 41 is elastically deformed, the pushing member 26A is inclined relative to the reference axis P attendantly on the deformation of the first helical compression spring 41, and a push switch 15 is pushed by the pushing projection 28 located just on the back side of the to-be-pressed part 39*c* now pressed.

Figure 9:
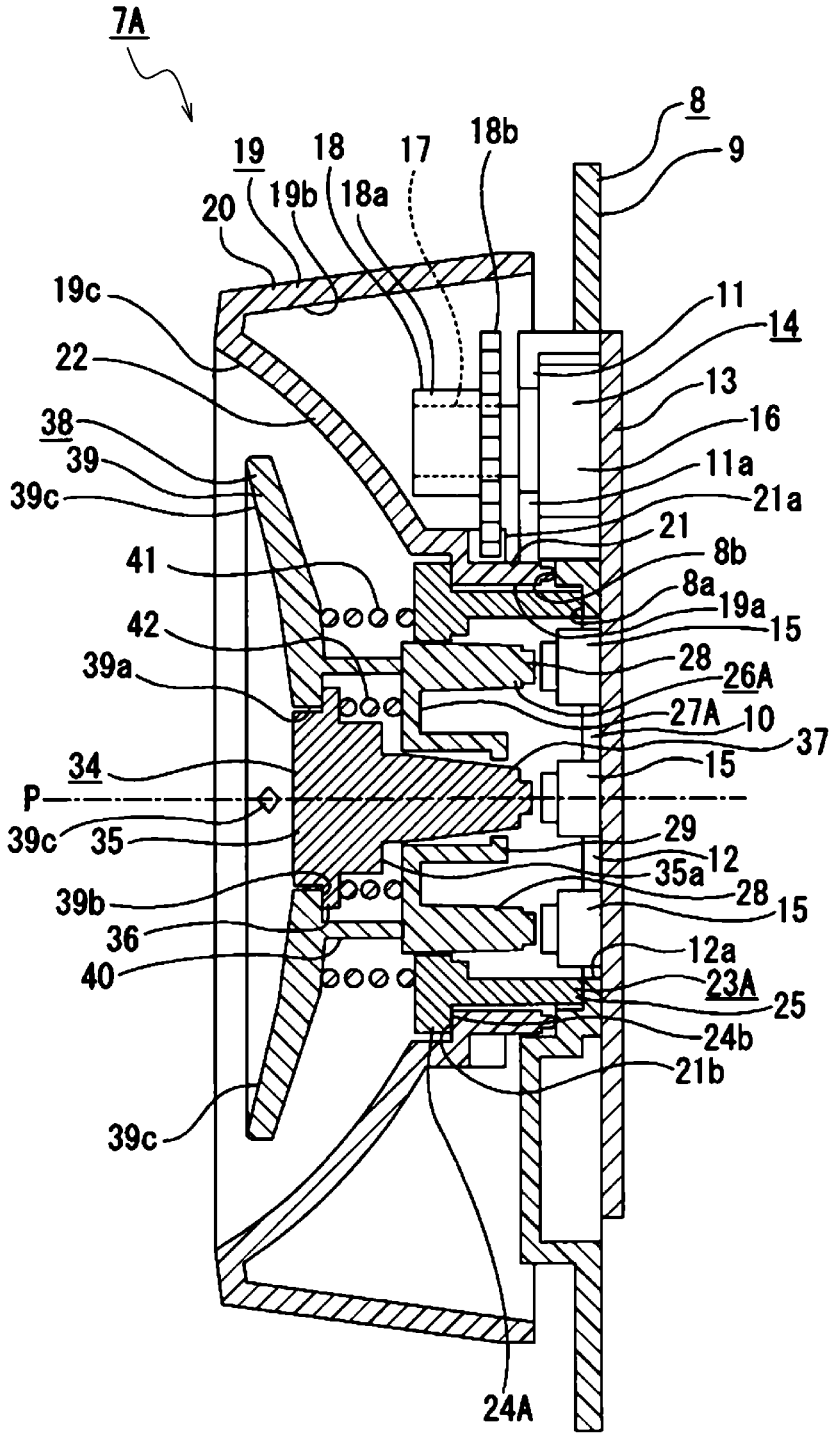
FIG. 9 is an enlarged sectional view of the operation unit.

When the pressing on the to-be-pressed part 39*c* having been pressed is released, the first helical compression spring 41 is elastically returned to the original form, and the pushing member 26A and the rocking key 38 are returned into their non-operation positions where they have been before operated (see FIG. 9).

Figure 11:
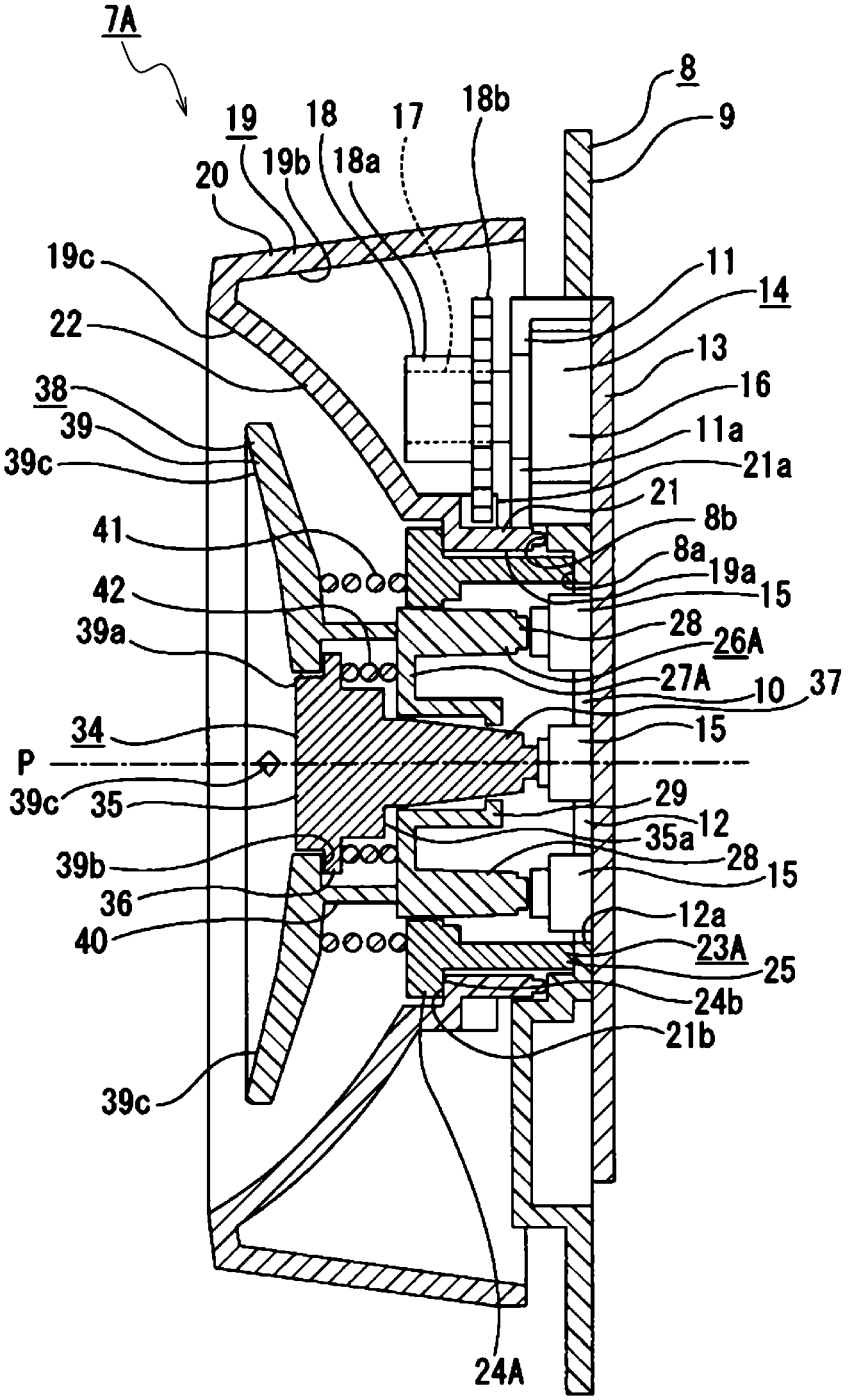
FIG. 11 is an enlarged sectional view showing a condition where a press key is operated.

On the other hand, when a to-be-acted part 35 of the press key 34 is pressed, the press key 34 is moved backward toward a press position (see FIG. 11). In this instance, the second helical compression spring 42 is pressed by the flange part 36 of the press key 34 from the front side, to be elastically deformed.

When the press key 34 is moved, the push switch 15 is pushed by a shaft part 37.

When the pressing on the to-be-acted part 35 having been pressed is released, the second helical compression spring 42 is elastically returned into the original form, and the press key 34 is returned into an initial position where it has been before operated (see FIG. 9).

As above-mentioned, in the operation unit 7A, the first helical compression spring 41 is used as an elastic member capable of elastic deformation by which the rocking key is returned from the operation position to the non-operation position. Accordingly, simplification of the structure of the operation unit 7A and a reduction in the manufacturing cost thereof can be promised.

Besides, in the operation unit 7A, the second helical compression spring 42 is used as an elastic member capable of elastic deformation by which the press key 34 is returned from the press position to the initial position. Therefore, simplification of the structure of the operation unit 7A and a reduction in the manufacturing cost thereof can be promised.

Furthermore, since the first helical compression spring 41 and the second helical compression spring 42 are arranged coaxially, thinning of the operation unit 7A in the axial direction (forward-backward direction) can be ensured through enhancement of space efficiency.

Summing-Up

As has been described above, in the operation unit 7, 7A, the rocking key 38 is inclined in such a manner that the position on the roughly 180° opposite side of the reference axis P from the to-be-pressed part 39*c* being pressed serves as a fulcrum. This ensures that the inclination angle θa and displacement Ha of the rocking key 38 can be reduced, while securing the moving distance D necessary for the pushing member 26, 26A to push the push switch 15.

Therefore, even where the operation unit 7, 7A is enlarged, the to-be-operated part 39 is less liable to make contact with other parts of the operation unit 7, 7A when the rocking key 38 is rocked. Accordingly, it is possible to achieve an enhanced operability and an enhanced reliability of operation through enlargement of the operation unit 7, 7A.

In addition, the rocking key 38 is provided with the plurality of to-be-pressed parts 39*c*, 39*c*, . . . which are arranged at intervals along the circumferential direction. This makes it possible to perform a plurality of different operations by using the single rocking key 38, and to enhance the operability of the operation unit 7, 7A.

Further, the rocking key 38 is disposed in the state of covering the arrangement hole 19*a* formed in the rotating dial 19. This ensures that penetration of dust via the arrangement hole 19*a* is restrained by the rocking key 38, and deposition of dust onto the push switches 15, 15, . . . arranged in the arrangement hole 19*a* or the like parts is suppressed, whereby reliability of operation can be enhanced.

Besides, since the rocking key 38 functions as means for restraining the penetration of dust via the arrangement hole 19*a*, it is unnecessary to provide any means for exclusive use for restraining the penetration of dust through the arrangement hole 19*a*, and, accordingly, it is possible to realize a simplified mechanism and a reduced manufacturing cost.

Furthermore, the arrangement space 19*b* is formed inside the rotating dial 19, a part of the encoder 14 is arranged in the arrangement space 19*b*, and the rotating gear 18 is meshed with the gear portion 21*a*.

This promises effective utilization of space, and also promises lightening of the load on the encoder 14, since the encoder 14 is not rocked in this configuration.

Besides, the rotating dial 19 includes the outer circumferential part 20 and the inner circumferential part 21 and the connection part 22, the inner circumferential part 21 is formed with the gear portion 21*a*, and the arrangement space 19*b* for arranging the encoder 14 is formed between the outer circumferential part 20 and the inner circumferential part 21.

Therefore, it is possible to achieve effective utilization of the arrangement space 19*b*, while realizing simplification of the structure of the rotating dial 19.

In addition, the insertion arrangement hole 39*a* is formed in a central portion of the rocking key 38, and the press key 34 is arranged in the insertion arrangement hole 39*a*. This ensures that the operation unit 7, 7A having the three operating parts, namely, the rotating dial 19, the press key 34 and the rocking key 38, can be configured with a simple structure.

Present Technology

It should be noted that the present technology can also take the following configuration.

(1) An operation unit including: a rotating dial operated by being rotated about a predetermined reference axis; a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated, wherein the rocking key is inclined when the to-be-pressed part is operated by being pressed, in such a manner that a position on a roughly 180° opposite side of the reference axis from the to-be-pressed part serves as a fulcrum.

(2) The operation unit of the above paragraph (1), wherein the rocking key is provided with a plurality of the to-be-pressed parts; and the plurality of to-be-pressed parts are located at intervals along a circumferential direction.

(3) The operation unit of the above paragraph (1) or (2), wherein the rotating dial is formed with an arrangement recessed part; the rotating dial is formed in a central portion thereof with an arrangement hole communicating with the arrangement recessed part; the push switch is arranged in the arrangement hole; and the rocking key is arranged in the arrangement recessed part in a state of covering the arrangement hole.

(4) The operation unit of one of the above paragraphs (1) to (3), wherein the rotating dial is formed therein with an arrangement space extending in a circumferential direction around the reference axis; the rotating dial is formed with a gear portion extending in a circumferential direction around the reference axis; at least a part of an encoder is arranged in the arrangement space; and the encoder is provided with a rotating gear meshed with the gear portion.

(5) The operation unit of the above paragraph (4), wherein the rotating dial is provided with an outer circumferential part, an inner circumferential part located on an inside of the outer circumferential part and spaced from the outer circumferential part, and a connection part by which an end portion of the outer circumferential part and an end portion of the inner circumferential part are interconnected; the inner circumferential part is formed with the gear portion; and the arrangement space is formed between the outer circumferential part and the inner circumferential part.

(6) The operation unit of one of the above paragraphs (1) to (5), wherein the rocking key is formed in a central portion thereof with an insertion arrangement hole; a press key operated by being pressed is disposed in the insertion arrangement hole; and a push switch is arranged which outputs an operation signal by being pushed when the press key is operated.

(7) The operation unit of the above paragraph (6), wherein the press key is moved between an initial position where it is located before operated by being pressed and a press position for pushing the push switch; an elastic member capable of elastic deformation is provided by which the press key is returned from the press position to the initial position when a pressing operation is released; and a sheet-formed rubber member oriented in an axial direction of the reference axis is used as the elastic member.

(8) The operation unit of the above paragraph (6), wherein the press key is moved between an initial position where it is located before operated by being pressed and a press position for pushing the push switch; an elastic member capable of elastic deformation is provided by which the press key is returned from the press position to the initial position when a pressing operation is released; and a helical compression spring expanded and contracted in an axial direction of the reference axis is used as the elastic member.

(9) The operation unit of one of the above paragraphs (1) to (6), wherein the rocking key is moved between a non-operation position where it is located before operated by being pressed and an operation position for pushing the push switch; an elastic member capable of elastic deformation is provided by which the rocking key is returned from the operation position to the non-operation position when a pressing operation is released; and a sheet-formed rubber member oriented in an axial direction of the reference axis is used as the elastic member.

(10) The operation unit of the above paragraph (9), wherein the rocking key is formed in a central portion thereof with an insertion arrangement hole; a press key operated by being pressed is disposed in the insertion arrangement hole; a push switch is provided which outputs an operation signal by being pushed when the press key is operated; the press key is moved between an initial position where it is located before operated by being pressed and a press position for pushing the push switch; and the rubber member is used as an elastic member capable of elastic deformation by which the press key is returned from the press position to the initial position when a pressing operation is released.

(11) The operation unit of one of the above paragraphs (1) to (6), wherein the rocking key is moved between a non-operation position where it is located before operated by being pressed and an operation position where it is located when operated by being pressed; an elastic member capable of elastic deformation is provided by which the rocking key is returned from the operation position to the non-operation position when a pressing operation is released; and a helical compression spring expanded and contracted in an axial direction of the reference axis is used as the elastic member.

(12) The operation unit of the above paragraph (11), wherein the rocking key is formed in a central portion thereof with an insertion arrangement hole; a press key operated by being pressed is disposed in the insertion arrangement hole; a push switch is provided which outputs an operation signal by being pushed when the press key is operated; the press key is moved between an initial position where it is located before operated by being pressed and a press position for pushing the push switch; an elastic member capable of elastic deformation is provided by which the press key is returned from the press position to the initial position when a pressing operation is released; a helical compression spring expanded and contracted in an axial direction of the reference axis is used as the elastic member; and the helical compression spring by which the rocking key is returned from the operation position to the non-operation position and the helical compression spring by which the press key is returned from the press position to the initial position are arranged coaxially.

(13) An electronic apparatus including: an operation unit; and a main body operated according to an operation on the operation unit, wherein the operation unit includes a rotating dial operated by being rotated about a predetermined reference axis, a rocking key which is disposed on an inside of the rotating dial, has a to-be-operated part formed with a to-be-pressed part operated by being pressed, and is operated by being inclined relative to the reference axis when the to-be-pressed part is pressed, and a push switch which outputs an operation signal by being pushed when the rocking key is operated, and the rocking key is inclined when the to-be-pressed part is operated by being pressed, in such a manner that a position on a roughly 180° opposite side of the reference axis from the to-be-pressed part serves as a fulcrum.

The specific shapes and structures of the parts in the best mode for carrying out the present technology as above-described are presented merely as an example in carrying out the present technology, and the technical scope of the present technology is not to be construed as being restricted thereby.

What is claimed is:

1. An operation unit comprising:

a rotating dial operated by being rotated about a predetermined reference axis;

a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated, wherein the rocking key is inclined when the to-be-pressed part is operated by being pressed, in such a manner that a position on a roughly 180° opposite side of the reference axis from the to-be-pressed part serves as a fulcrum;

the rotating dial is formed therein with an arrangement space extending in a circumferential direction around the reference axis;

the rotating dial is formed with a gear portion extending in a circumferential direction around the reference axis;

at least a part of an encoder is arranged in the arrangement space; and the encoder is provided with a rotating gear meshed with the gear portion.

2. The operation unit according to claim 1, wherein the rotating dial is provided with an outer circumferential part, an inner circumferential part located on an inside of the outer circumferential part and spaced from the outer circumferential part, and a connection part by which an end portion of the outer circumferential part and an end portion of the inner circumferential part are interconnected;

the inner circumferential part is formed with the gear portion; and the arrangement space is formed between the outer circumferential part and the inner circumferential part.

3. The operation unit according to claim 1, wherein the rocking key is formed in a central portion thereof with an insertion arrangement hole;

a press key operated by being pressed is disposed in the insertion arrangement hole; and a push switch is arranged which outputs an operation signal by being pushed when the press key is operated.

4. An operation unit comprising:

a rotating dial operated by being rotated about a predetermined reference axis;

a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated, wherein the rocking key is inclined when the to-be-pressed part is operated by being pressed, in such a manner that a position on a roughly 180° opposite side of the reference axis from the to-be-pressed part serves as a fulcrum;

the rocking key is formed in a central portion thereof with an insertion arrangement hole;

a press key operated by being pressed is disposed in the insertion arrangement hole;

a push switch is arranged which outputs an operation signal by being pushed when the press key is operated;

the press key is moved between an initial position where it is located before operated by being pressed and a press position for pushing the push switch;

an elastic member capable of elastic deformation is provided by which the press key is returned from the press position to the initial position when a pressing operation is released; and a sheet-formed rubber member oriented in an axial direction of the reference axis is used as the elastic member.

5. An operation unit comprising:

a rotating dial operated by being rotated about a predetermined reference axis;

a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated, wherein the rocking key is inclined when the to-be-pressed part is operated by being pressed, in such a manner that a position on a roughly 180° opposite side of the reference axis from the to-be-pressed part serves as a fulcrum;

the rocking key is formed in a central portion thereof with an insertion arrangement hole;

a press key operated by being pressed is disposed in the insertion arrangement hole;

a push switch is arranged which outputs an operation signal by being pushed when the press key is operated;

the press key is moved between an initial position where it is located before operated by being pressed and a press position for pushing the push switch;

an elastic member capable of elastic deformation is provided by which the press key is returned from the press position to the initial position when a pressing operation is released; and a helical compression spring expanded and contracted in an axial direction of the reference axis is used as the elastic member.

6. An operation unit comprising:

a rotating dial operated by being rotated about a predetermined reference axis;

a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated, wherein the rocking key is inclined when the to-be-pressed part is operated by being pressed, in such a manner that a position on a roughly 180° opposite side of the reference axis from the to-be-pressed part serves as a fulcrum;

the rocking key is moved between a non-operation position where it is located before operated by being pressed and an operation position for pushing the push switch;

an elastic member capable of elastic deformation is provided by which the rocking key is returned from the operation position to the non-operation position when a pressing operation is released; and a sheet-formed rubber member oriented in an axial direction of the reference axis is used as the elastic member.

7. The operation unit according to claim 6, wherein the rocking key is formed in a central portion thereof with an insertion arrangement hole;

a press key operated by being pressed is disposed in the insertion arrangement hole;

a push switch is provided which outputs an operation signal by being pushed when the press key is operated;

the press key is moved between an initial position where it is located before operated by being pressed and a press position for pushing the push switch; and the rubber member is used as an elastic member capable of elastic deformation by which the press key is returned from the press position to the initial position when a pressing operation is released.

8. An operation unit comprising:

a rotating dial operated by being rotated about a predetermined reference axis;

a rocking key which is disposed on an inside of the rotating dial, has a to-be-operated part formed with a to-be-pressed part operated by being pressed, and is operated by being inclined relative to the reference axis when the to-be-pressed part is pressed; and a push switch which outputs an operation signal by being pushed when the rocking key is operated, wherein the rocking key is inclined when the to-be-pressed part is operated by being pressed, in such a manner that a position on a roughly 180° opposite side of the reference axis from the to-be-pressed part serves as a fulcrum;

the rocking key is moved between a non-operation position where it is located before operated by being pressed and an operation position where it is located when operated by being pressed;

an elastic member capable of elastic deformation is provided by which the rocking key is returned from the operation position to the non-operation position when a pressing operation is released; and a helical compression spring expanded and contracted in an axial direction of the reference axis is used as the elastic member.

9. The operation unit according to claim 8, wherein the rocking key is formed in a central portion thereof with an insertion arrangement hole;

a press key operated by being pressed is disposed in the insertion arrangement hole;

a push switch is provided which outputs an operation signal by being pushed when the press key is operated;

the press key is moved between an initial position where it is located before operated by being pressed and a press position for pushing the push switch;

an elastic member capable of elastic deformation is provided by which the press key is returned from the press position to the initial position when a pressing operation is released;

a helical compression spring expanded and contracted in an axial direction of the reference axis is used as the elastic member; and the helical compression spring by which the rocking key is returned from the operation position to the non-operation position and the helical compression spring by which the press key is returned from the press position to the initial position are arranged coaxially.

10. An electronic apparatus comprising:

an operation unit; and a main body operated according to an operation on the operation unit, wherein the operation unit includes a rotating dial operated by being rotated about a predetermined reference axis, a rocking key which is disposed on an inside of the rotating dial, has a to-be-operated part formed with a to-be-pressed part operated by being pressed, and is operated by being inclined relative to the reference axis when the to-be-pressed part is pressed, and a push switch which outputs an operation signal by being pushed when the rocking key is operated, and the rocking key is inclined when the to-be-pressed part is operated by being pressed, in such a manner that a position on a roughly 180° opposite side of the reference axis from the to-be-pressed part serves as a fulcrum, the rotating dial is formed therein with an arrangement space extending in a circumferential direction around the reference axis, the rotating dial is formed with a gear portion extending in a circumferential direction around the reference axis;

at least a part of an encoder is arranged in the arrangement space, and the encoder is provided with a rotating gear meshed with the gear portion.

* * * * *